US005121517A

United States Patent [19]

Frentzel-Beyme

[11] Patent Number: 5,121,517

[45] Date of Patent: Jun. 16, 1992

[54] METHOD OF SETTING AND DYEING YARN

[75] Inventor: Johannes Frentzel-Beyme, Moenchengladbach, Fed. Rep. of Germany

[73] Assignee: Palitex Project Company GmbH, Krefeld, Fed. Rep. of Germany

[21] Appl. No.: 628,100

[22] Filed: Dec. 13, 1990

[30] Foreign Application Priority Data

Dec. 28, 1989 [DE] Fed. Rep. of Germany ..... 3943130

[51] Int. Cl.[5] ..... D06B 5/18

[52] U.S. Cl. ..... 8/149.1; 68/5 C

[58] Field of Search ..... 8/149.1; 68/5 C, 7

[56] References Cited

U.S. PATENT DOCUMENTS 3,692,464 9/1972 Furness ..... 8/149.1
3,871,821 3/1975 Winn et al. ..... 8/149.1
3,967,923 7/1976 Ameling ..... 08/149.1
4,082,502 4/1978 von der Eltz et al. ..... 8/149.1
4,300,251 11/1981 Santens et al. ..... 8/149.1

FOREIGN PATENT DOCUMENTS 1785485 7/1971 Fed. Rep. of Germany .
1936352 7/1972 Fed. Rep. of Germany .
1740169 6/1973 Fed. Rep. of Germany .

*Primary Examiner*—Philip R. Coe
*Attorney, Agent, or Firm*—Bell, Seltzer, Park & Gibson

[57] ABSTRACT

A bobbin sleeve for a setting bobbin, consisting of a cylinder jacket bounded on both sides by end flanges and consisting of rigid, more especially metallic material is characterized in that the cylinder jacket is provided with continuous apertures, so that the setting process and a subsequent dyeing process can be carried out on one and the same bobbin sleeve.

4 Claims, 3 Drawing Sheets

METHOD OF SETTING AND DYEING YARN

FIELD OF THE INVENTION

The invention relates to a bobbin sleeve for a setting bobbin, consisting of a cylinder jacket bounded on both sides by end flanges and made of rigid, more especially metallic material.

BACKGROUND OF THE INVENTION

For the setting, more especially thermosetting, of threads or yarn it is known to use a rigid heat-resistant bobbin sleeve, consisting more especially of metal, onto which the yarn is wound in close parallel layers.

The thread tensile forces arising during the thermosetting have to be absorbed by the sleeve body. The forces are directed radially towards the center of the sleeve. The shaping of a heat- and compression-resistant setting sleeve thus differs very severely from a conventional perforated dyeing sleeve. The winding diameter has to be very large, in order on the one hand to offer sufficient delivery weight for a following process, but on the other hand to make the thread layers wound parallel on the body non-elastic (non-resilient) relative to the next thread layers wound thereabove. Only thus can the shrinkage process succeed whilst maintaining the thread length.

In order to be able to dye the yarn material after the setting, the yarn is rewound in a rewinding process into cheese bobbins. The bobbin sleeves used for this purpose are provided in the region of the sleeve jacket with apertures, in order to allow a dye liquor to flow through the sleeves and the yarn package wound thereon from the inside outwardly and/or conversely. For this dyeing process, several bobbins are set onto a dye or liquor lance and are pressed against one another in the region of the front surfaces of the sleeve, in order to be able to allow the dye liquor in each case to flow through several bobbin bodies stacked one above the other. After conclusion of the dyeing process, the yarn is then dried and then rewound in a further rewinding process to form the bobbins intended for the end consumption.

Each rewinding of the yarn causes the yarn or respectively the thread to become hairier, which is undesirable for many kinds of yarn, more especially for sewing thread.

OBJECT AND SUMMARY OF THE INVENTION

The problem underlying the invention is to shape a sleeve in such a way that for the carrying out of the setting process and the carrying out of the dyeing process a rewinding of the thread or of the yarn can be dispensed with.

To solve this problem the bobbin sleeve in accordance with the invention is characterized in that the cylinder jacket of the setting bobbin is provided with continuous apertures, in such a way that, for the dyeing process following the setting process, the yarn package wound onto the setting bobbin sleeve can be flowed through directly from the inside outwardly and/or conversely by the dye liquor, without the yarn having to be rewound from the setting bobbin to form a dyeing bobbin.

The edges of the apertures are preferably rounded off or chamfered on the outside of the cylinder jacket. In order to be able to treat several setting bobbins stacked one above the other jointly in one dyeing stage, in which respect it is to be guaranteed that the dye liquor cannot flow through between bobbins stacked one above the other by-passing the yarn packages, in accordance with the further invention provision is made for the fact that the one end flange of the bobbin sleeve is provided at its outer front surface with a ring groove and the other end flange is provided on its outside with a ring tongue which is complementary to the ring groove. In this way, in the case of bobbins stacked one above the other, a reliable seal between adjacent bobbin sleeves is ensured, more especially if the bobbins or respectively bobbin sleeves stacked one above the other are pressed against one another with an adequate force in the axial direction.

The method in accordance with the invention for the setting, more especially for the thermosetting, and for the dyeing of yarn can be carried out in such a way that the yarn wound onto the bobbin sleeve in accordance with the invention is first of all subjected to a setting process and then to a dyeing process, or also in such a way that the yarn wound onto the bobbin sleeve is first of all subjected to the dyeing process and then to the setting treatment. In the case of the second mode of precedure the setting treatment, more especially thermosetting treatment, at the same time brings about drying of the previously wet-dyed material.

BRIEF DESCRIPTION OF THE DRAWINGS

The invention will be described in more detail hereinunder with reference to the drawings.

DETAILED DESCRIPTION OF PREFERRED EMBODIMENT OF THE INVENTION

Figure 1:
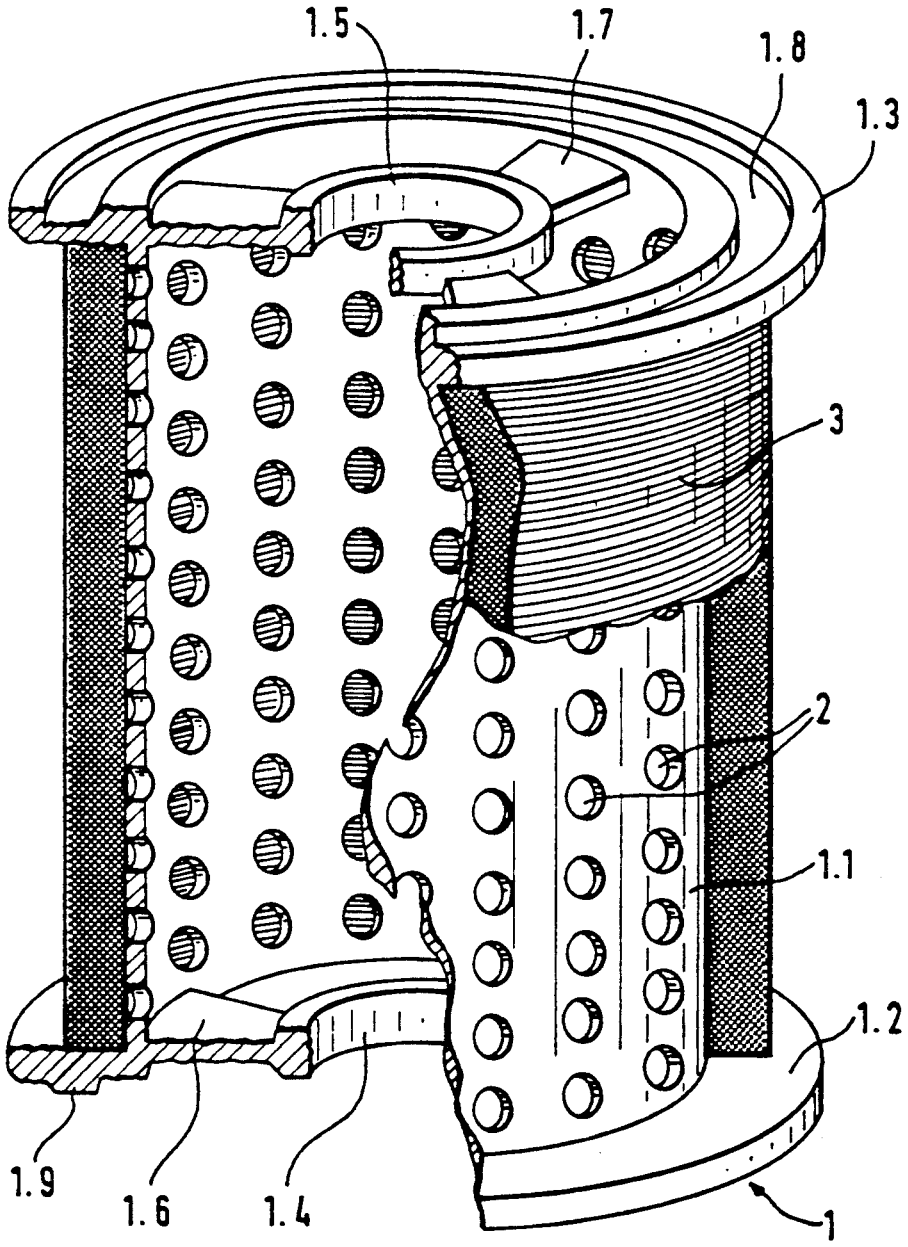
FIG. 1 shows partially in section a perspective representation of the bobbin sleeve in accordance with the invention with a yarn package wound thereon.

FIG. 1 shows a bobbin sleeve in the form of a so-called disc sleeve 1, consisting of a cylinder jacket 1.1, two end flanges 1.2 and 1.3 as well as hub bodies in the form of centering rings 1.4, 1.5 and hub spokes 1.6 and 1.7. The upper end flange 1.3 is provide with an annular groove 1.8 and the lower end flange 1.2 is provided with a ring tongue 1.9 which is complementary to the ring groove 1.8. In accordance with FIG. 1 the cylinder jacket 1.1 is provided with apertures 2 distributed over its circumference. A yarn package 3 is wound in tight parallel layers onto the bobbin sleeve 1, in which respect preferably first of all a flexible stocking or the like has been drawn onto the cylinder jacket.

Figure 2:
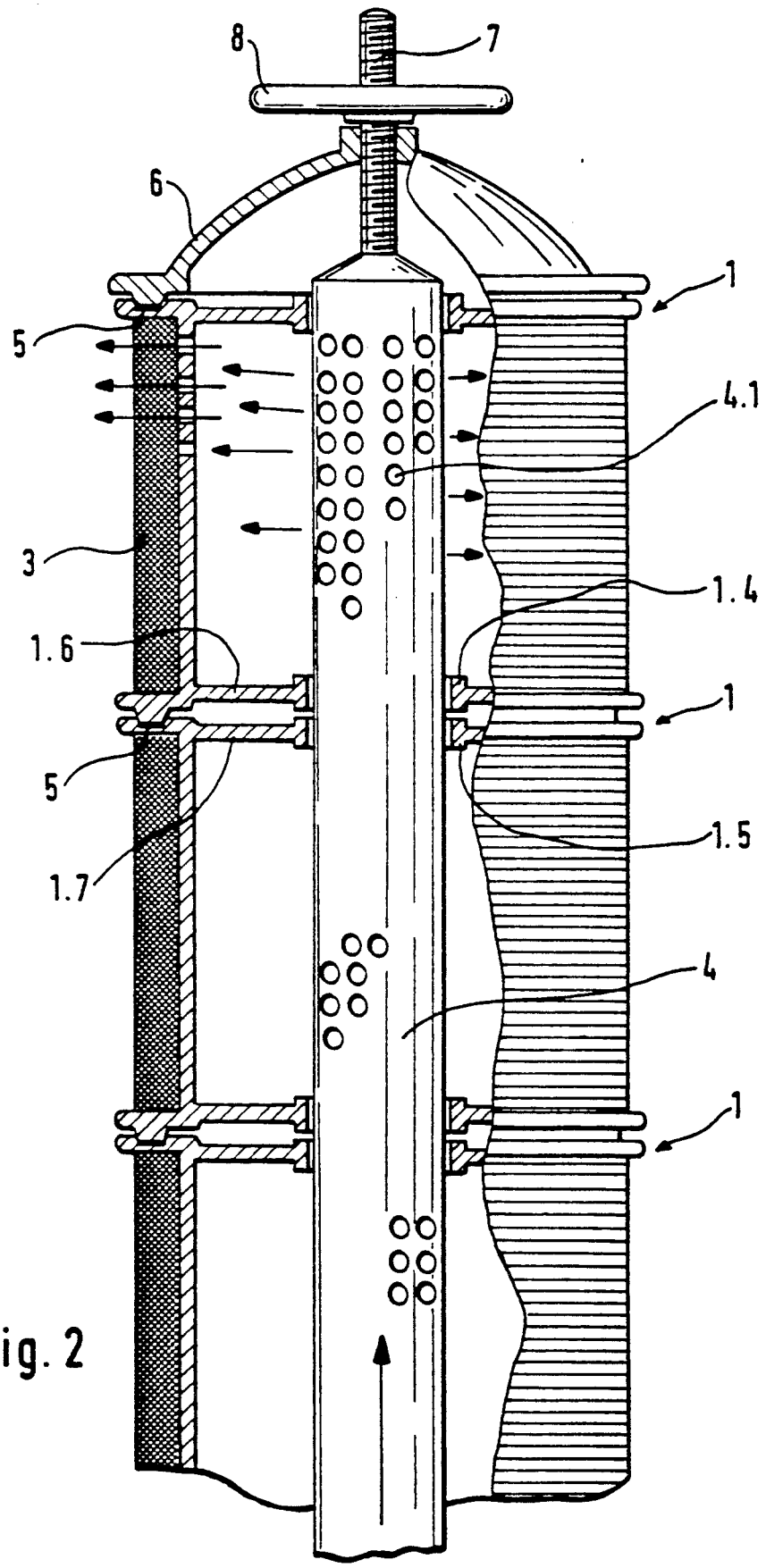
FIG. 2 shows a side view of several bobbins or respectively bobbin sleeves wound one above the other for the performance of the dyeing process, and FIG. 3. shows a perspective representation of a dyeing tank for carrying out the dyeing process.

FIG. 2 shows in section the superimposing of several bobbins or respectively bobbin sleeves 1 onto a dye or liquor lance 4, which is provided with apertures 4.1. The individual bobbins or respectively bobbin sleeves 1 are so placed one above the other that in each case the ring tongue of the one bobbin enters into the ring groove of the other bobbin, in which respect in the appropriate circumstances heat-resistant seals 5 can be placed inbetween. A closure lid 6 is placed onto the topmost bobbin. The securing of the lid 6 is effected by means of a threaded pin 7 which is positioned at the upper end of the liquor lance 8 and onto which a threaded wheel 8 is screwed.

For the carrying out of the dyeing process the dyeing liquor can flow through the yarn packages 3 either from the inside outwardly, by the dye liquor being fed through the liquor lance 4 or the dye liquor can flow through the yarn packages 3 from the outside inwardly, if the dye liquor is supplied at the outside and is led away through the liquor lance 4.

Figure 3:
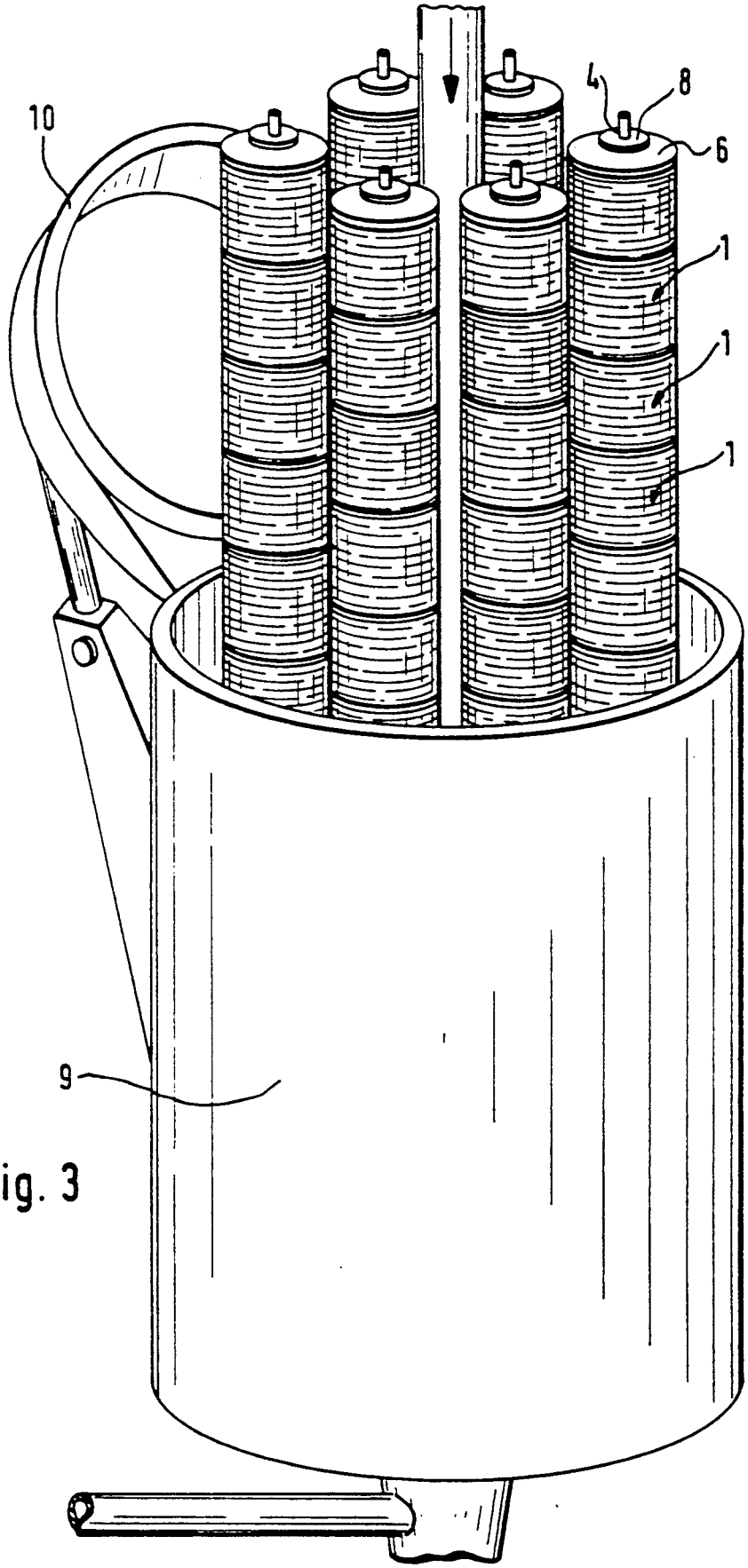

FIG. 3 shows how a set of several liquor lances 4 can be accommodated standing side-by-side parallel to one another in a dyeing tank 9, the upper side of which can be closed by means of a lid 10. Suitable connection sockets for the liquor lances 4 are positioned inside the dyeing vat 9, in order to allow the dye liquor to flow in the one or in the other direction through the yarn packages 3.

The fixing and the dyeing of the yarn can be effected in such a way that either first of all the fixing, more especially thermofixing, e.g. by means of hot air, and then the dyeing process are carried out, or by first of all dyeing being carried out and then, e.g. by means of hot air, fixing being carried out.

The bobbin sleeve 1 can consist of any suitable rigid, preferably heat-resistant material, for example of cast aluminum, stainless steel and so forth.

What is claimed is:

1. A method of treating yarn, particularly sewing thread, comprising the steps of:

winding yarn into a yarn package in tight dense parallel layers onto a bobbin sleeve in the form of a cylindrical jacket bound on both sides by end flanges and made of rigid material and having continuous apertures through the jacket; and subjecting the thus wound yarn package to both a thermosetting treatment and a dyeing treatment without unwinding and rewinding of the yarn between such treatments, wherein the thermosetting treatment includes subjecting the yarn to a hot air treatment of sufficient temperature to effect heat setting of the yarn and wherein the dyeing treatment includes flowing dye liquor through the wound yarn package including the parallel yarn layers and the apertures of the bobbin sleeve.

2. A method of treating yarn, as set forth in claim 1, in which said step of subjecting the yarn to both a thermosetting treatment and a dyeing treatment comprises first subjecting the yarn package to a dyeing treatment and then subjecting the yarn package to a thermosetting treatment.

3. A method of treating yarn, as set forth in claim 1, in which said step of subjecting the yarn package to both a thermosetting treatment and a dyeing treatment comprises first subjecting the yarn package to a thermosetting treatment and then subjecting the yarn package to a dyeing treatment.

4. A method of treating yarn, particularly sewing thread, comprising the steps of:

winding yarn into a yarn package in tight dense parallel layers onto a bobbin sleeve in the form of a cylindrical jacket bound on both sides by end flanges and made of rigid material and having continuous apertures through the jacket with chamfered edges at the outside of the jacket, a ring groove on the outer front surface of one end flanges and a ring tongue on the outer front surface of the other flange which is complimentary with the ring groove;

mounting a plurality of the thus wound yarn packages in longitudinal alignment onto a liquor lance having dye flow apertures therein and positioning the ring tongue of one wound yarn tube in the ring groove of the next longitudinally aligned wound yarn package; and subjecting the thus wound yarn package to both a thermosetting treatment and a dyeing treatment without unwinding and rewinding of the yarn between such treatments, wherein the thermosetting treatment includes subjecting the yarn to a hot air treatment of sufficient temperature to effect heat setting of the yarn and wherein the dyeing treatment includes flowing dye liquor from the liquor lance through the apertures of the bobbin sleeve and through he parallel layers of yarn.

* * * * *